United States Patent [19]

Swaffield

[11] Patent Number: 4,684,189

[45] Date of Patent: Aug. 4, 1987

[54] HIGH VOLTAGE PLUG AND RECEPTACLE

[75] Inventor: John D. Swaffield, Woburn, Mass.

[73] Assignee: Alden Research Foundation, Brockton, Mass.

[21] Appl. No.: 768,140

[22] Filed: Aug. 22, 1985

[51] Int. Cl.[4] ..... H01R 11/00

[52] U.S. Cl. ..... 439/587

[58] Field of Search ..... 339/60 R, 60 C, 60 M, 339/59 R, 59 M, 94 R, 94 M, 94 C

[56] References Cited

U.S. PATENT DOCUMENTS 4,090,759 5/1978 Herrmann, Jr. ..... 339/60 M

FOREIGN PATENT DOCUMENTS 2131633 6/1984 United Kingdom ..... 339/60 M

*Primary Examiner*—Gil Weidenfeld
*Assistant Examiner*—Paula A. Austin
*Attorney, Agent, or Firm*—James H. Grover

[57] ABSTRACT

A high voltage electrical coupling has two parts, each with spaced mating conductors, one part forming a socket shaped to receive the body of the second part. The second coupling part has an elastic, insulative support forming sleeves around its conductors and a slot between the sleeves. The first part has an insulative barrier wall extending between its conductors and fitting in the slot of the second part. Either the socket of the first coupling part or the elastic body of the second part are tapered into the socket so that the elastic body is compressed against the barrier wall as the parts are mated, thereby squeezing closed any possible air path along the surfaces of the barrier wall.

4 Claims, 5 Drawing Figures

HIGH VOLTAGE PLUG AND RECEPTACLE

BACKGROUND OF THE INVENTION

Two-part electrical couplings for electrical lines commonly have a plug with a pair of conductor terminals mating with the pair of terminals of a receptacle. In high voltage electrical couplings there is a danger of arcing between two terminals in the coupling and insulative sleeves may be used around one or both pairs of terminals. At high voltages arcing may still occur along indirect air or moisture paths formed outside the insulation and it is the object of this invention to eliminate such indirect arcing between insulated terminals.

SUMMARY OF THE INVENTION

According to the invention a two-part multiconductor, high voltage electrical coupling comprises a first coupling part having two parallel, spaced conductor terminals, an insulative body supporting the terminals and forming a socket around the terminals, and an insulative barrier wall extending from the body between the terminals; and a second coupling part having two spaced conductors mating with the terminals of the first part, an elastic, insulating support body for the conductors forming sleeves around the mating conductors respectively and a slot between the sleeves; the socket of the first coupling part being shaped to receive the body of the second part with barrier wall snugly fitting in the slot, and at least one of said body and socket diminishing in cross section into the socket so as to compress the elastic body laterally against the barrier wall thereby to squeeze closed any air path along the barrier wall between spaced conductors.

DRAWINGS

DESCRIPTION

Figure 1:
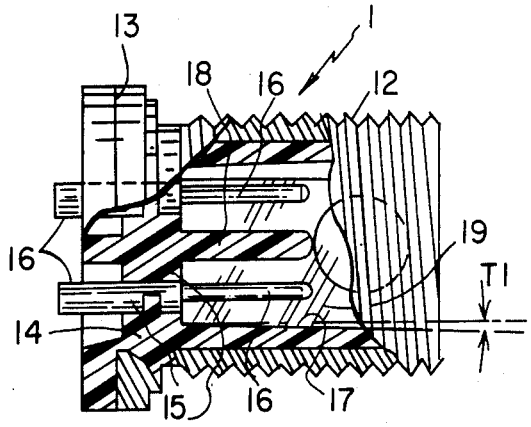
FIG. 1 is a side view of the plug part of a two-part coupling, partly broken away.
Figure 2:
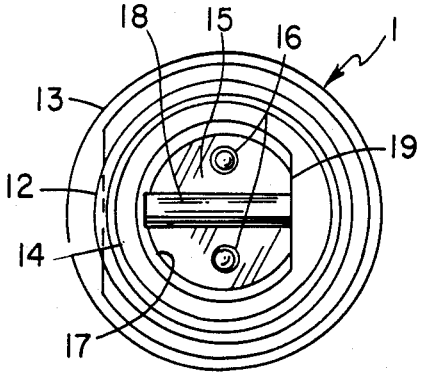
FIG. 2 is an end view of the plug of FIG. 1.
Figure 4:
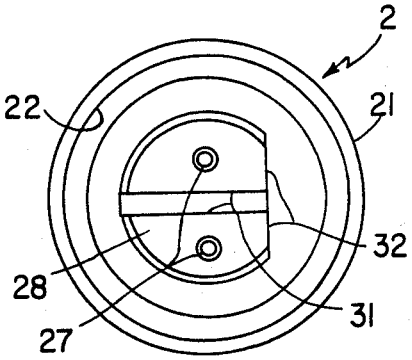
FIG. 4 is an end view of the receptacle of FIG. 3.
Figure 3:
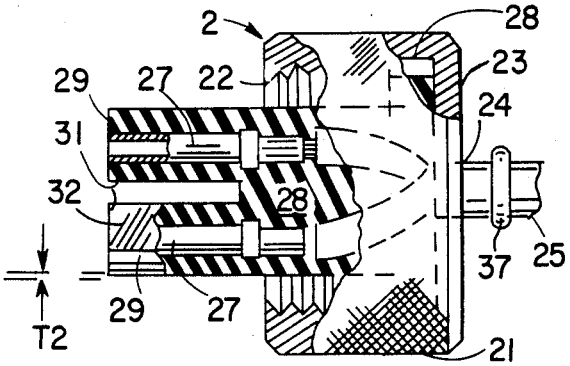
FIG. 3 is a side view of the receptacle part of the two-part coupling, partly broken away.

FIGS. 1 and 2 show the first, receptacle part 1 of a two-part high voltage electrical coupling, the receptacle including a tubular metal shell 11 with threads 12 extending from a flange 13. Anchored within the shell is a cup-shaped body 14 of hard insulating material such as glass filled thermoplastic such as VALOX plastic of General Electric Company, Schenectady, N.Y.

The body has an end wall 15 in which two conductor terminal pins 16 are mounted extending into a socket 17 within the insulative cup. Between the pins is a barrier wall 18 integral with and extending from the end wall 15 of the cup and spanning the socket 17 diametrically from one side to a flat 19 on the other side of the socket. The diametric cross section of the socket diminishes into the socket with a taper T1 of one degree, for example.

Figure 5:
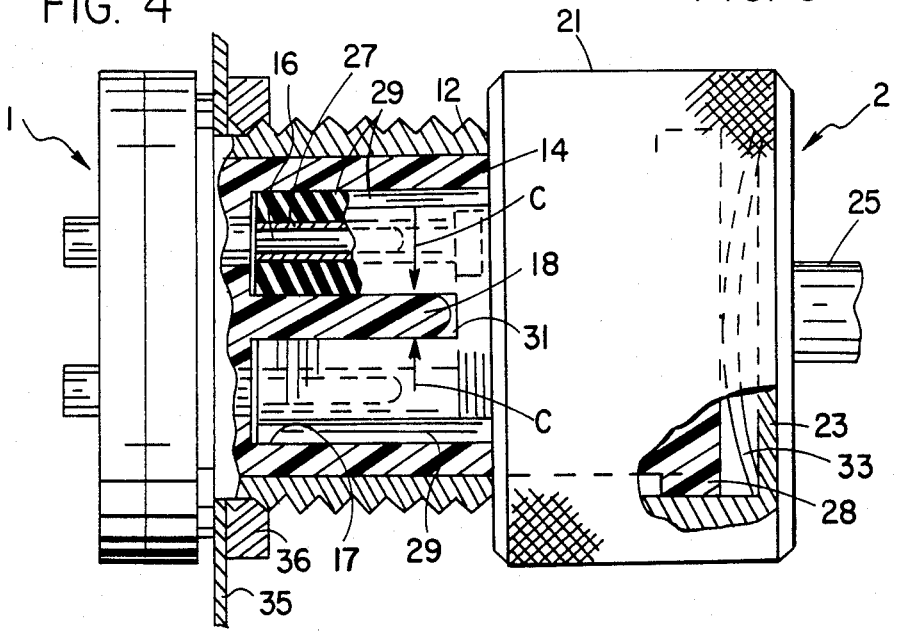
FIG. 5 is a side view of the plug and receptable of FIGS. 1 to 4 shown mated and partly broken away.

The second, plug part 2 of the coupling includes a knurled nut 21 with internal threads 22 matching the receptacle threads 12. An end wall 23 has an opening 24 for a cable 25 of two or more insulated wires 26 electrically connected to tubular conductors 27 which mate with the conductor terminal pins 16 of the plug part 1 of the coupling. The mating conductors 27 are held in a silicone rubber support body 28 with a durometer rating of 70 and a Shore rating of A. The rubber support body has two integral sleeves 29 having the insulative and elastic properties of the body, which sleeves surround the mating conductors 27 and form a slot 31 between the sleeves with the same dimensions as the barrier wall 18 of the receptacle part 1. The sleeves diminish in cross section with a taper T2 toward their ends at an angle of one half degree, for example, and have coplanar flats 32 matching the flat 19 of the socket in the receptacle part. The support body 28 is loosely confined in the nut 21 by an annular rib 37 around the cable 24 and by the end wall 23 of the unit 21. As shown in FIG. 5 a metal spring washer 33 is compressed between the wall 23 and the body 28.

As shown in FIG. 5 the first, receptacle part 1 is attached at an opening in a panel 35 by a nut 36. Insulated conductors are then connected to the left end of the pins 16 and the pins and connections are covered with high voltage insulation to prevent arcing externally of the coupling. The coupling is then completed by screwing the nut 21 of the second, plug part 2 onto the thread of the first, receptacle part 2. Until the coupling is completed high voltage should not be applied to either part of the coupling. As the sleeves 29 on the body 28 of the plug part are forced into a snug fit in the socket of the receptacle part their taper laterally compresses the elastic sleeves, as indicated by the arrows C, against the barrier wall 18 in the slot 31 between them squeezing closed any air path between the conductors 16, 27 up one side of the barrier wall and down the other. No other path is available since the barrier wall spans the socket 17 dividing it into two isolated volumes receiving the two sleeves 29. A significant reduction in the tendency for arcing and an increase in the high voltage capacity of the coupling results. The spring washer 33 pressed on the end of the elastic by the nut 21 maintains the squeeze on the barrier wall and compensates for relaxation of the elastic sleeves because of temperature change or the like.

It should be understood that the present disclosure is for the purpose of illustration only and that this invention includes all modifications and equivalents which fall within the scope of the appended claims.

What is claimed is:

1. A two-part multiconductor high voltage electrical coupling comprising:

a first coupling part having two parallel, spaced conductor terminals, an insulative body supporting the terminals and forming a socket around the terminals, and an insulative barrier wall extending from the body between the terminals; and a second coupling part having two spaced conductors mating with the terminals of the first part, an elastic, insulating support body for the conductors forming sleeves around the mating conductors respectively and a slot between the sleeves;

the socket of the first coupling part being shaped to receive the support body of the second part with the barrier wall snugly fitting in the slot, and said support body and socket having opposed mating surfaces continuously diminishing in cross section into the socket so as to compress the elastic body laterally against the barrier wall thereby continuously to squeeze closed any air path along the barrier wall between spaced conductors, the coupling including spring means pressing endwise against the support body to maintain the squeeze of the elastic sleeve on the barrier wall.

2. A coupling according to claim 1 wherein the barrier wall spans the socket isolating the conductors in separate volumes of the socket.

3. A coupling according to claim 1 wherein the barrier wall and socket have continuously mating faces.

4. A coupling according to claim 1 including a nut on the second coupling part with threads engaging matching threads on the first coupling part, the nut having an end wall compressing the spring means against the support body.

* * * * *